US009593454B2

(12) United States Patent
Bürgin

(10) Patent No.: US 9,593,454 B2
(45) Date of Patent: Mar. 14, 2017

(54) BARRIER SYSTEM

(71) Applicant: MAGNETIC AUTOCONTROL GMBH, Shopfheim (DE)

(72) Inventor: Thomas Bürgin, Lörrach (DE)

(73) Assignee: MAGNETIC AUTOCONTROL GmbH, Schopfheim (DE)

( * ) Notice: Subject to any disclaimer, the term of this patent is extended or adjusted under 35 U.S.C. 154(b) by 0 days.

(21) Appl. No.: 14/542,018

(22) Filed: Nov. 14, 2014

(65) Prior Publication Data

US 2015/0139726 A1 May 21, 2015

(30) Foreign Application Priority Data

Nov. 15, 2013 (DE) ..... 20 2013 010 383 U

(51) Int. Cl.

| | |
|---|---|
| ***E01F 13/04*** | (2006.01) |
| ***E01F 13/06*** | (2006.01) |
| ***B61L 29/04*** | (2006.01) |

(52) U.S. Cl.

CPC ..... *E01F 13/06* (2013.01); *B61L 29/04* (2013.01)

(58) Field of Classification Search

CPC . E01F 13/04; E01F 13/06; E01F 13/12; E01F 15/088; E01F 9/0111; E01F 9/0112; E01F 9/0118

USPC ..... 404/6; 49/9, 34, 49

See application file for complete search history.

(56) References Cited

U.S. PATENT DOCUMENTS 565,206 A * 8/1896 Hicks ..... E01F 13/06 49/49
1,613,019 A * 1/1927 Caudle ..... B60Q 1/34 116/35 A
2,137,193 A * 11/1938 Stafford ..... E01F 13/06 49/171

(Continued)

FOREIGN PATENT DOCUMENTS

DE 211965 7/1909
DE 23 00 944 3/1974

(Continued)

OTHER PUBLICATIONS

PDF of screenshot of Wikipedia entry for Four-bar linkages with Wayback Machine date, Jan. 24, 2010.*

(Continued)

*Primary Examiner* — Thomas B Will
*Assistant Examiner* — Katherine Chu
(74) *Attorney, Agent, or Firm* — Horst M. Kasper

(57) ABSTRACT

A barrier system for alternately shutting and opening the vehicle entrance or pedestrian entrance of two lines or transport paths which cross one another and of which one is at least twice as wide as the other. On the four corners of the lines (15, 16) which cross one another, in each case one barrier system (17) with in each case one barrier boom (1, 18) which can be pivoted horizontally out of the vehicle entrance of one line (15) into the vehicle entrance of the other line (16) is installed. Two of the barrier systems (17) which lie diagonally opposite to one another and have in each case one barrier boom (1) which can be folded lengthwise from an elongate position. The two other barrier systems (17) which lie diagonally opposite to one another have in each case one conventional barrier boom (18) which is rigid over its entire length.

14 Claims, 14 Drawing Sheets

(56) References Cited

Figure 1:
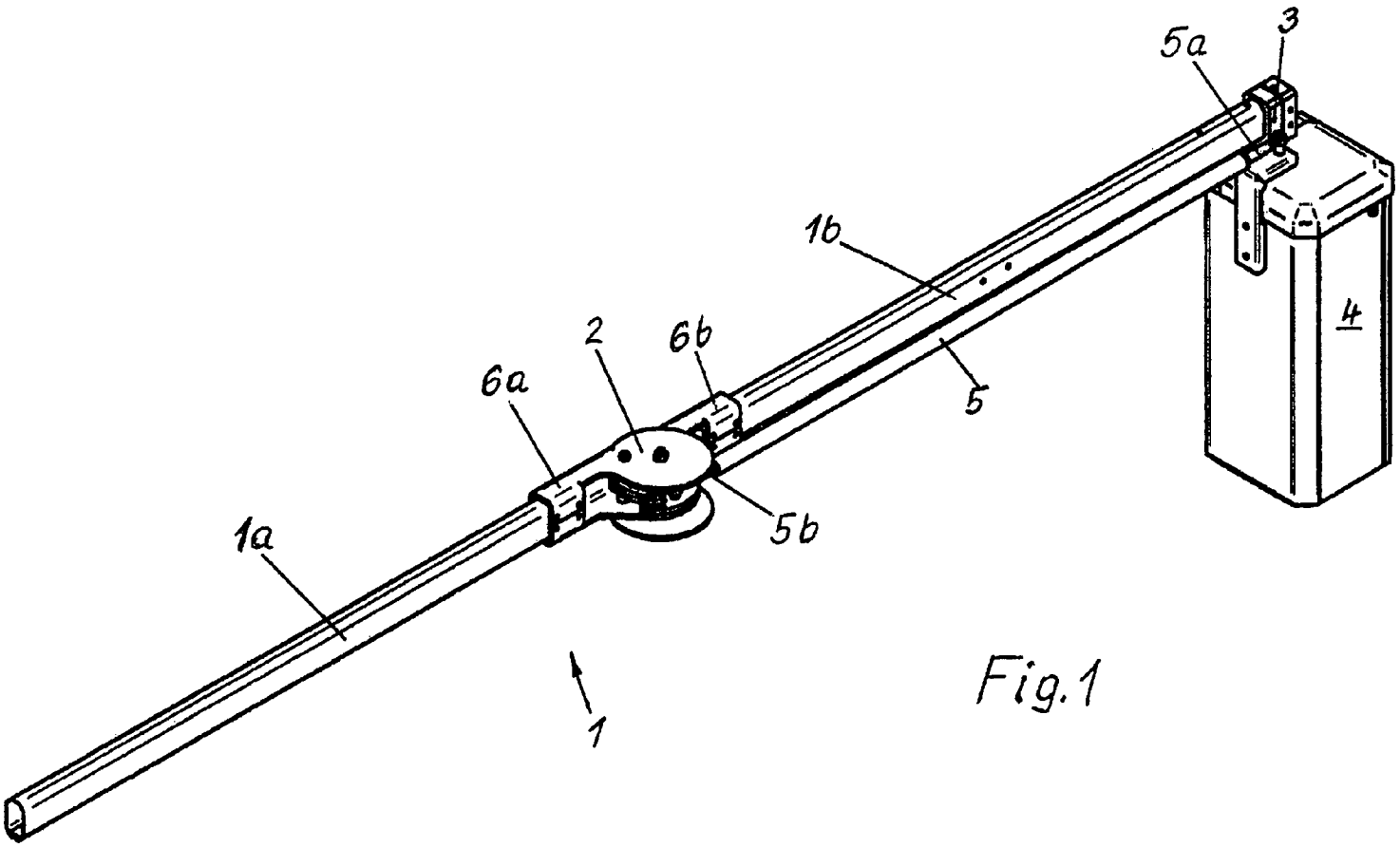

U.S. PATENT DOCUMENTS 2,633,825 A * 4/1953 Smith ..... A63K 3/02 119/426
2,874,493 A * 2/1959 Mandel ..... B61L 29/023 172/799.5
3,925,930 A * 12/1975 Gail ..... E01F 13/06 49/124
4,531,325 A * 7/1985 Phillips ..... E01F 13/06 49/49
4,554,695 A * 11/1985 Rowland ..... F41H 11/08 14/69.5
4,844,653 A * 7/1989 Dickinson ..... E01F 13/06 404/6
6,212,825 B1 4/2001 Hopkins, Jr.
6,340,139 B1 * 1/2002 Hilleary ..... B61L 29/30 246/125
6,402,421 B1 * 6/2002 Ottavi ..... E01F 15/006 256/13.1
6,966,146 B2 * 11/2005 Pease ..... B61L 29/10 49/49
7,237,979 B2 * 7/2007 Behan ..... E01F 13/06 404/6
8,181,392 B1 * 5/2012 Farber ..... E01F 13/06 404/10
8,596,587 B2 * 12/2013 Hilleary ..... B61L 23/041 246/111
2013/0133264 A1 * 5/2013 Melkes ..... E01F 13/06 49/49
2014/0161523 A1 * 6/2014 Ball ..... E01F 13/12 404/6

FOREIGN PATENT DOCUMENTS

DE 37 199 12 A1 12/1988
DE 100 199 57 A1 10/2001
DE 202 12342 U1 7/2003
EP 0937 820 B1 10/2003
EP 2 597 199 A1 5/2013
EP 2 597 199 B1 11/2013
JP 2006029007 A 2/2006

OTHER PUBLICATIONS 4 (four) printed pages from website, dated Jan. 20, 2015 (http://www.zufahrtssysteme.com/schranken) FAAC Zufahrtskontrolle & Systeme Schranken bis zu 8m Sperrbreite For the following two cases the document could not be downloaded: 1. www.aliexpress.com/store/product/Automatic-Barrier-Gate-System-with-articulated-arm-for-parking-access-control/233325_1338998902.html. 2. EP14003825.8.

* cited by examiner

BARRIER SYSTEM

The invention relates to a barrier system for selectively shutting and opening the vehicle entrance or pedestrian entrance of two lines or transport paths which cross one another and of which one is at least twice as wide as the other.

A perennial problem in the case of barrier systems of a very wide variety of types consists in that the space which is available for the movement of the barrier boom can be very limited.

Various proposals have already been made for the use of barrier systems at entranceways or vehicle entrances which are limited vertically, in particular compared with their width.

DE 37 19 912 A1 has disclosed a barrier boom which can be pivoted by 90° in a vertical plane and consists of two sections which are connected to one another in an articulated manner at their one ends which are adjacent to one another. In the position which shuts the vehicle entrance, the entire barrier boom protrudes horizontally into said vehicle entrance and its two sections are situated in a position, in which they are aligned with one another. During the vertical pivoting of the barrier boom by 90° from its position which shuts the vehicle entrance into its position which opens the vehicle entrance, the front section which has the free end of the barrier boom is angled away by 90° in a vertical plane in relation to the rear section which can be driven by way of a drive apparatus, with the aid of a chain drive which is arranged along the driveable section, whereas it again assumes the position which is aligned with the driveable section during the return of the barrier boom into the position which shuts the vehicle entrance.

According to EP 0937 820 B1, the front section of a two-part barrier boom of this type can likewise be angled away in a vertical plane by 90° during the vertical movement of the barrier boom into the open position with the aid of a control cable which is arranged in the hollow, driveable section.

Barrier booms of this type are used, above all, for shutting and opening vehicle entrances with a low height, for example in the case of vehicle entrances into underground car parks. In particular in the case of vehicle entrances with a width which is considerably greater in relation to the low height, the width of the vehicle entrance can still be shut and opened sufficiently by way of a barrier boom of this type. However, in the open position, the front section which is angled away by 90° still protrudes into the vehicle entrance, even if it is in an elevated position, as a result of which the usable height of the vehicle entranceway or vehicle entrance which is already low per se is reduced further, with the result that vehicles over a certain height or vehicles with superstructures cannot pass or enter.

DE 211 965 has disclosed a barrier boom which consists of two sections which are connected to one another in an articulated manner, in the case of which barrier boom, in the shut position of the barrier boom, the front section which has the free end of the barrier boom is angled away purely passively in a horizontal plane in relation to the driveable section when a vehicle drives against the front section when the barrier is closed. In this way, accidents are to be prevented, in particular at railway level crossings. A vehicle which is still situated between the two barrier booms after both barrier booms of a railway level crossing have closed can thus still leave the said region.

It has already been proposed, in the case of vehicle entrances or vehicle entranceways which are wide in relation to their height, to use a barrier boom, by way of which the entire width of the vehicle entrance or vehicle entranceway can be shut, and which barrier boom can be pivoted over its entire length by 90°, but in a horizontal plane, in order to open the vehicle entrance or vehicle entranceway. However, the space which is available for the said horizontal movement is likewise limited in most cases and is frequently insufficient.

DE 2 300 944 has disclosed a barrier boom which can be pivoted in a vertical plane and consists of two parts which are connected to one another at their one ends in an articulated manner, that is to say such that they can be bent away. The one, rear part piece is articulated on a barrier post and the other, front part piece has the free end of the barrier boom. A supporting rod is articulated with its one end on the barrier post and is connected in an articulated manner with its other end to the front part piece of the barrier boom; the articulation point of the supporting rod on the front part piece of the barrier boom is spaced apart from the articulated connection between the front and rear part piece of the barrier boom. When the barrier is closed, the two part pieces of the barrier boom are aligned with one another in the horizontal direction and the barrier boom is supported in its entirety by the supporting rod in this position. During opening of the barrier, the rear part piece of the barrier boom pivots upwards in a vertical plane by approximately 90° at its articulation point on the barrier post, whereas the front part piece pivots downwards at the linkage of the two part pieces, the supporting rod also being driven during the movement. When the barrier is open, the rear part piece of the barrier boom therefore points upwards from the barrier post, whereas the front part piece appears to be folded away downwards. As a result, the barrier can be of lower construction in relation to the shut region.

Barrier systems have also been used, in which the problem of the space which is available only to a limited extent for the movement of a barrier boom has been solved by way of two barrier booms which lie opposite one another at the vehicle entrance or at the pedestrian entrance and of which each can shut and open half the width of the vehicle entrance or the pedestrian entrance.

An important area of use of barrier systems is that of paths or lines which cross one another, such as assembly lines in automotive engineering or baggage transport lines in airports. On assembly lines, the assembly belts which are moved in one direction are interrupted again and again at regular intervals by delivery lines which cross and on which the assembly parts for the next assembly operation are delivered. In the case of baggage transport systems in airports, the transport lines are also interrupted at intervals by delivery lines which cross and on which further baggage items are delivered. These are only two examples for an area of use of this type.

Paths or lines of this type which cross then have to be shut and opened again alternately in one direction and the other direction. It goes without saying that the space which is available for the movement of barrier booms is also very limited here, for example in assembly halls. Systems have been disclosed in the meantime, in which four barrier booms which lie opposite one another are installed at the path crossing points, which barrier booms can be pivoted alternately with respect to one another by 90°, preferably in a horizontal plane, each individual barrier boom being able to shut in each case part, preferably half, of the path width.

This has been proven in the cases in which the two lines or paths which cross one another have the same width. Even if one of the two lines has up to twice the width of the other, the lines can still be shut completely in both directions by way of conventional barrier booms if the length of a barrier boom is at most equal to the width of the narrower line; it then has to be accepted that overlapping occurs at the barrier booms when shutting the narrower line. However, if one of the two lines is more than twice as wide as the line which crosses it, the wider line can no longer be shut completely.

It is an object of the present invention, using suitable barrier booms, to provide a barrier system which can advantageously be used on lines or paths of a considerably different width which cross one another and have to be alternately shut or opened in one direction and the other direction, in such a way that the lines or paths can be shut and opened completely in both directions; it is to be noted that the space which can be utilized for the movement of one or more barrier booms is also usually very limited here.

According to the invention, this is achieved by way of a barrier boom according to claim 1.

In accordance with the invention, on the four corners of the lines which cross one another, in each case one barrier system with in each case one barrier boom which can be pivoted horizontally out of the vehicle entrance of one line into the vehicle entrance of the other line is installed; here, two of the barrier systems which lie diagonally opposite one another have in each case one barrier boom which can be folded lengthwise from an elongate position, and the two other barrier systems which lie diagonally opposite one another have in each case one conventional barrier boom which is rigid over its entire length. The vehicle entrance of the wider line can thus be shut by way of a foldable barrier boom in its elongate position together with a barrier boom which is rigid over its entire length. The vehicle entrance of the narrower line can be shut by way of a barrier boom which is folded lengthwise together with a barrier boom which is rigid over its entire length. As a result of the use of the foldable barrier booms, the space which is required for their movement for alternately shutting two lines which cross one another is reduced considerably.

The barrier booms which can be folded lengthwise preferably consist in each case of two sections, namely of a front section which has the free end of the barrier boom and a rear driveable section which is connected to a drive apparatus. Said sections of each of said barrier booms can advantageously be connected to one another at their ends which abut one another by way of a four-bar linkage (linkage with four degrees of freedom), and the front section which has the free end of the respective barrier boom can then be pivoted in the four-bar linkage from an elongate position which is aligned with the driveable section into a position which is folded back onto the driveable section, and back again.

The lengths of the barrier booms and of their sections can advantageously be selected in such a way that the barrier booms which can be folded lengthwise cover more than half the vehicle entrance of the wider line in their elongate position, that is to say with front and driveable sections which are aligned with one another, and the barrier booms which are rigid over the entire length cover the remaining part of the vehicle entrance of the wider line. The lines can thus be shut and opened completely in both directions. Overlapping of the barrier booms, which is not disruptive, results during the shutting of the narrower line. It is an advantage that no parts of the barrier booms protrude into the opened vehicle entrance here.

According to one preferred embodiment, the four-bar linkage of each foldable barrier boom has a connector for the front section of the barrier boom, which section has the free end of the barrier boom, and a connector for the rear, driveable section of the barrier boom, and the connector of the front section can be pivoted about a central axis of the four-bar linkage in relation to the connector of the driveable section until it lies parallel to the connector of the driveable section. Moreover, the four-bar linkage has two levers which are connected to one another at their one ends such that they can be pivoted about a common axis; one lever is connected by way of its second end to the connector of the driveable section such that it can be pivoted about an axis, and the other lever is connected by way of its second end to the connector of the front section of the barrier boom such that it can be pivoted about an axis. The lever which is connected in an articulated manner to the connector of the driveable section has a point of action for a guide rod which is arranged parallel to the driveable section and can be pivoted together with the latter. By way of a linkage of this type, the front section can be folded back onto the driveable section by practically 180°, that is to say into a parallel position.

If the length of the front section which has the free end of the barrier boom is equal to the length of the driveable section, the length of the folded barrier boom can be shorter by half than the overall length of the barrier boom in its elongate position; it is then correspondingly space-saving during its movement.

However, the front section which has the free end of the barrier boom can also be shorter than the driveable section if, for example, the local conditions make this appear advantageous.

Figure 2:
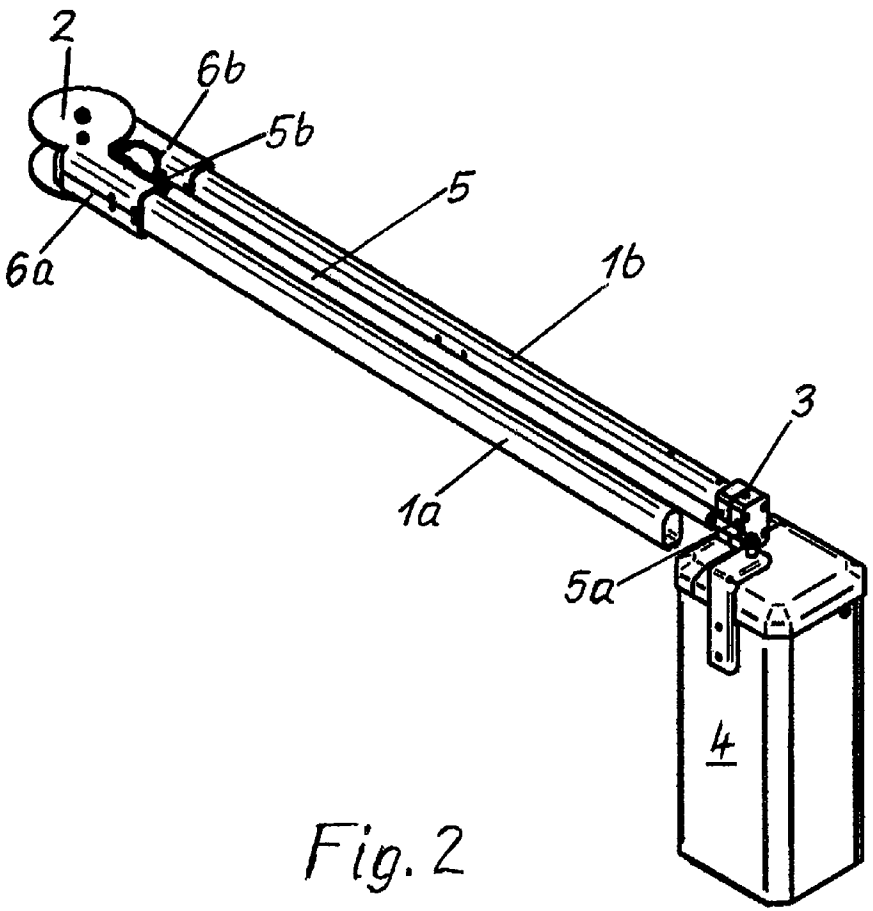
Figure 3:
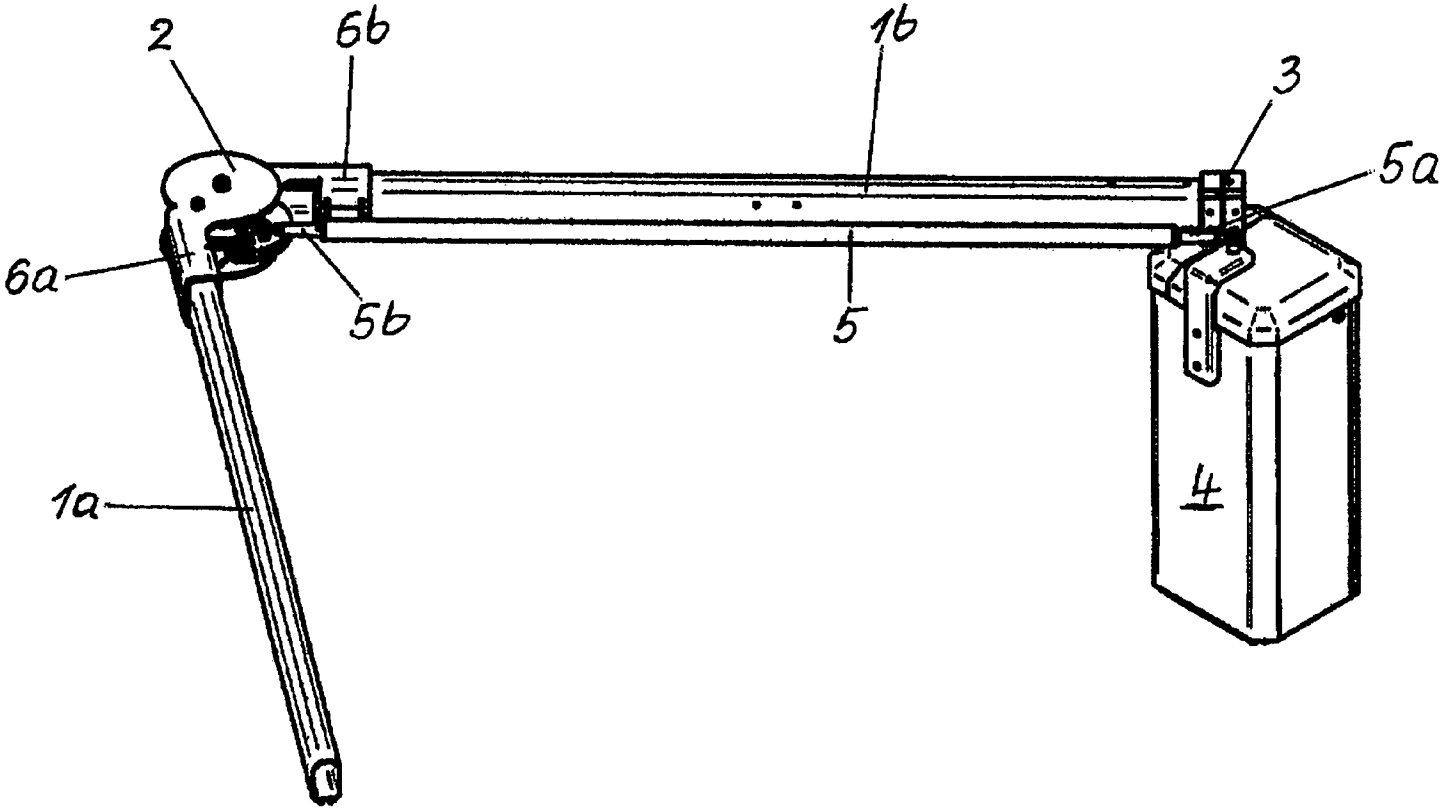
Figure 4:
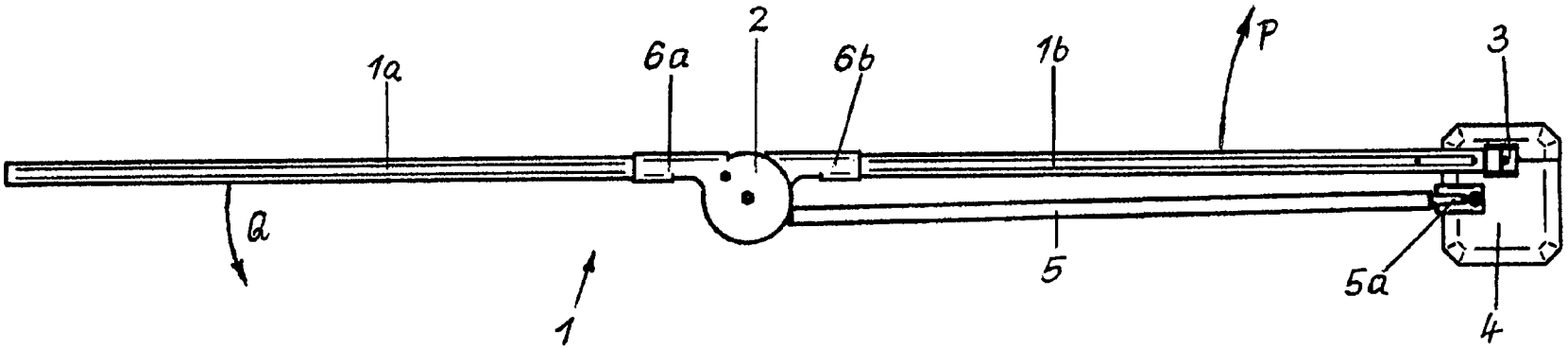
Figure 5:
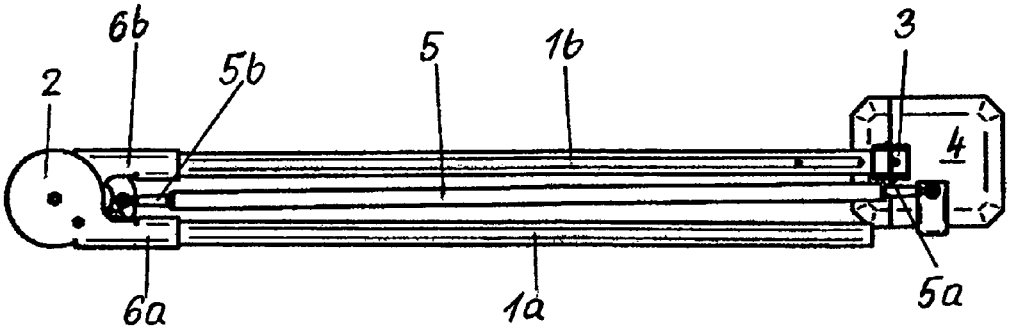
Figure 6:
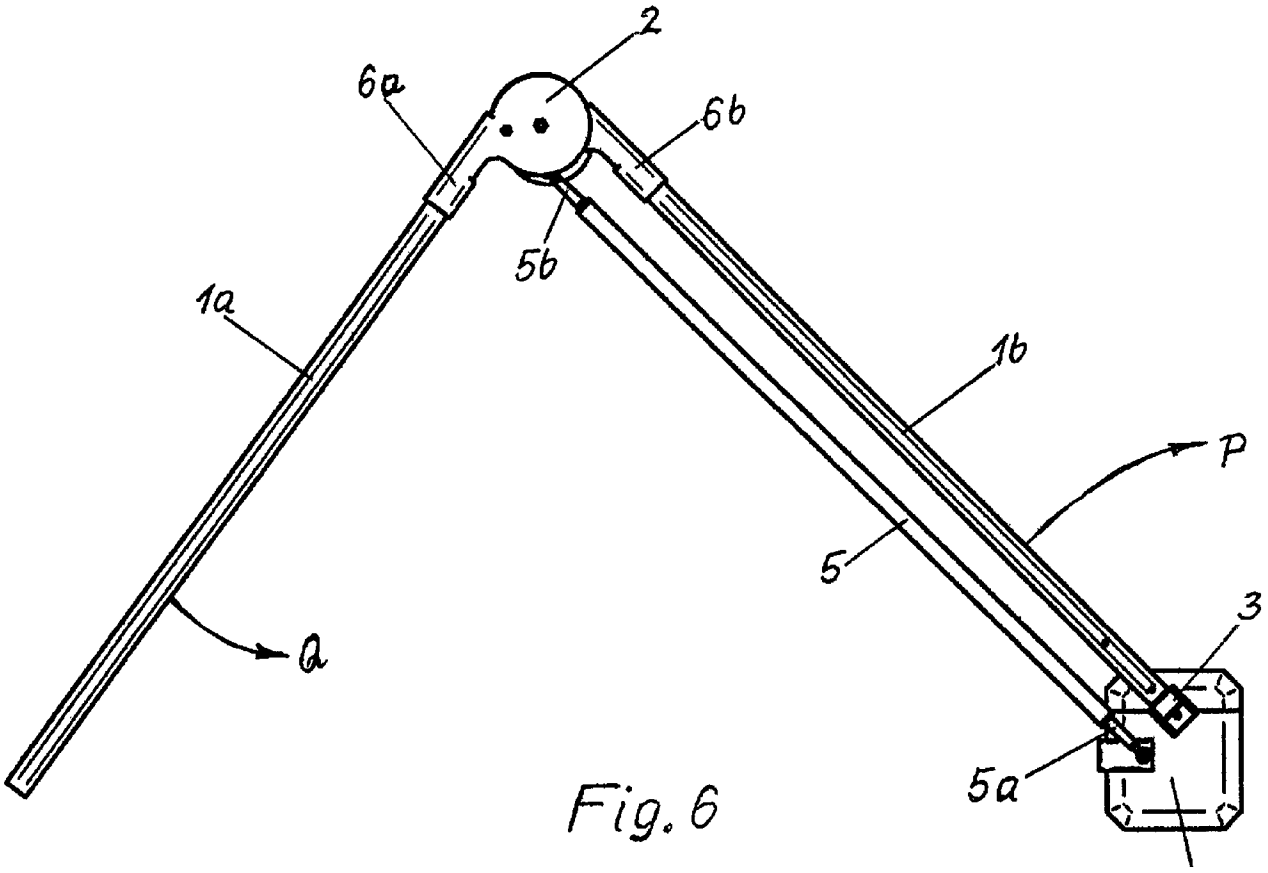
Figure 7:
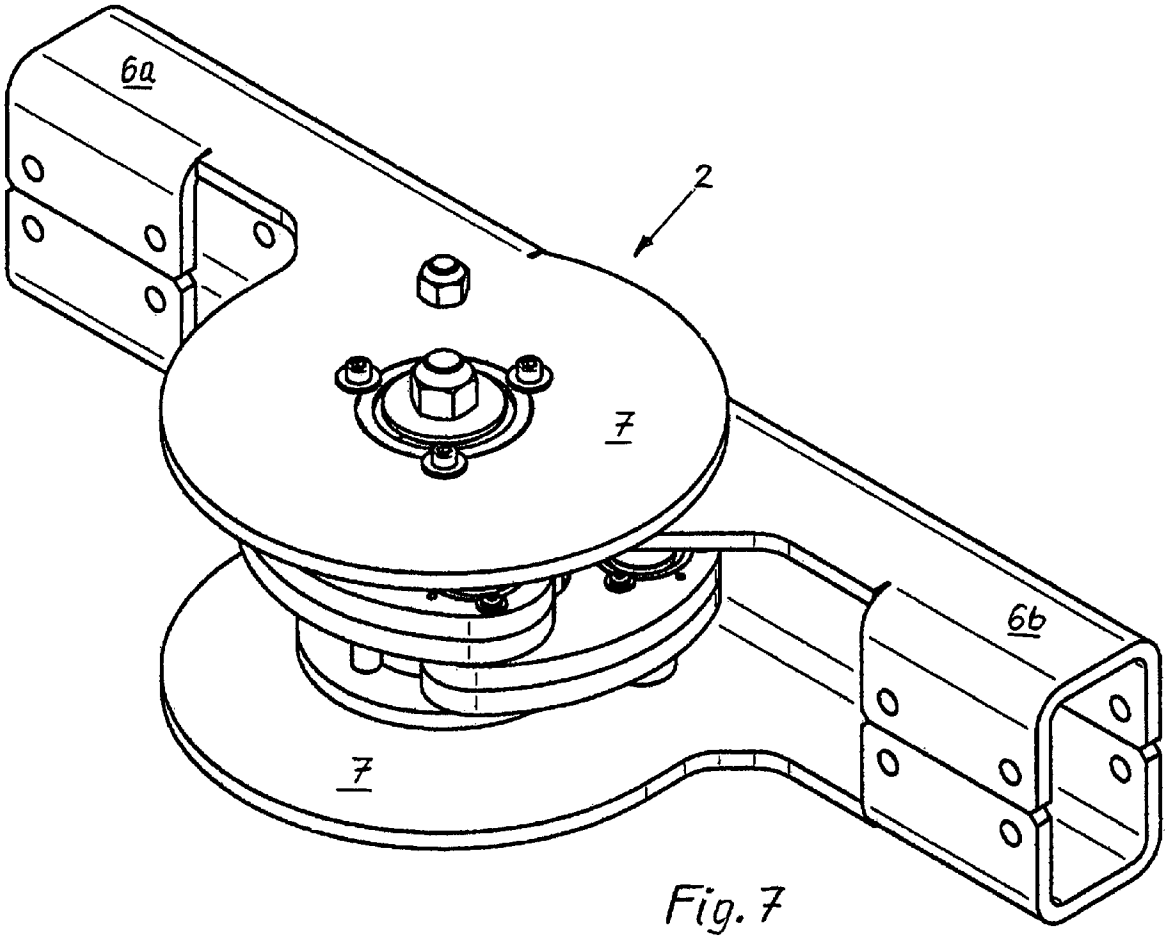
Figure 8:
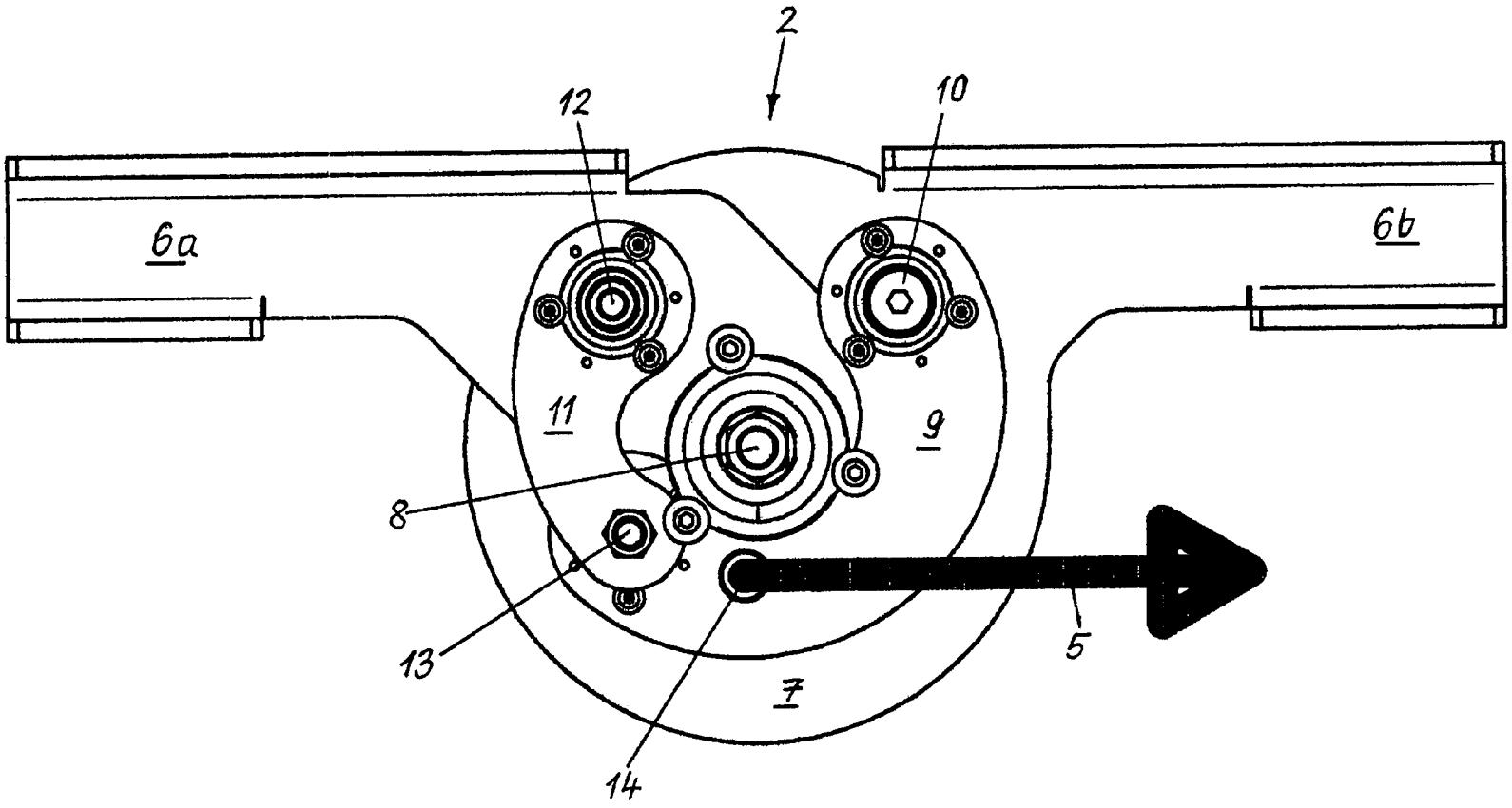
Figure 9:
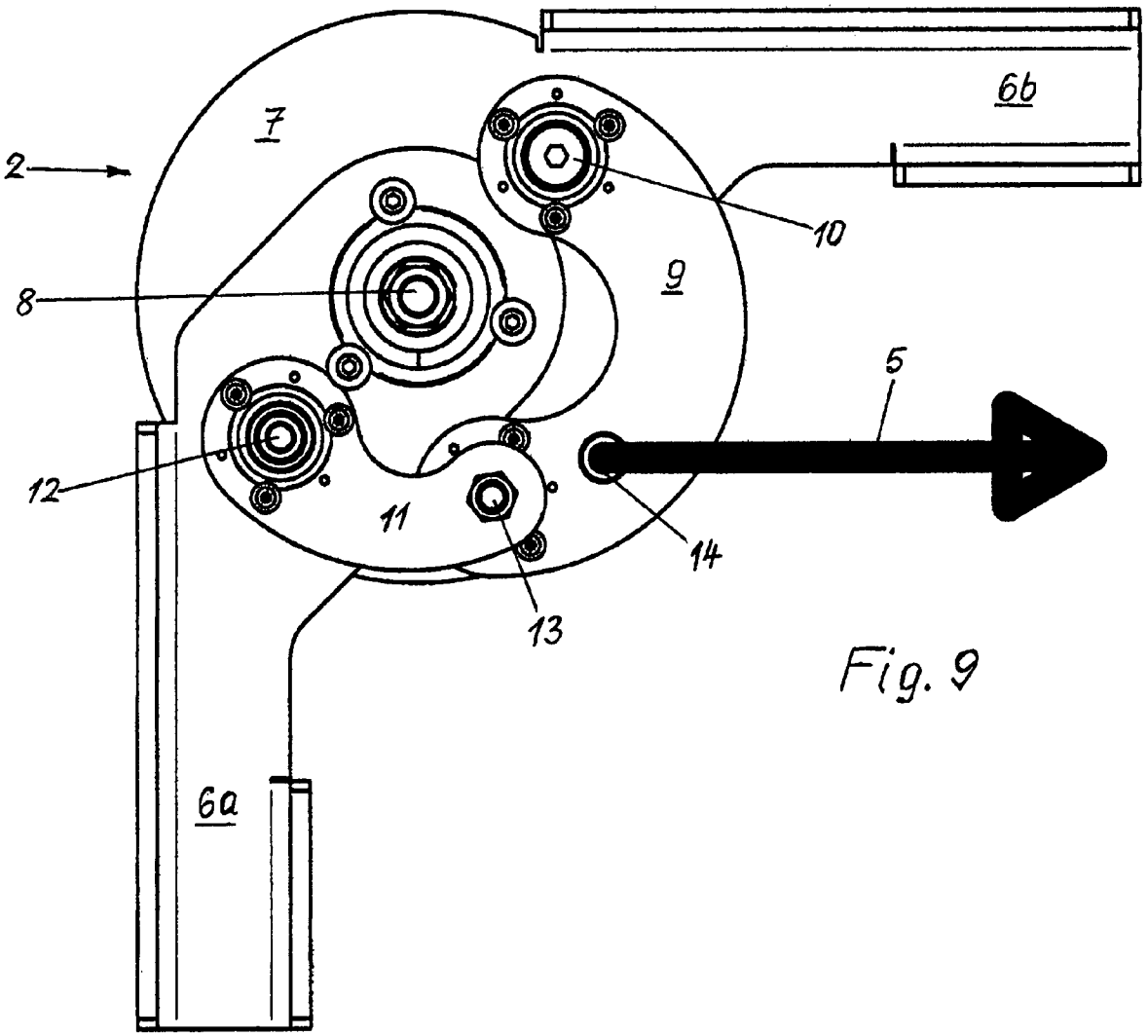
Figure 10:
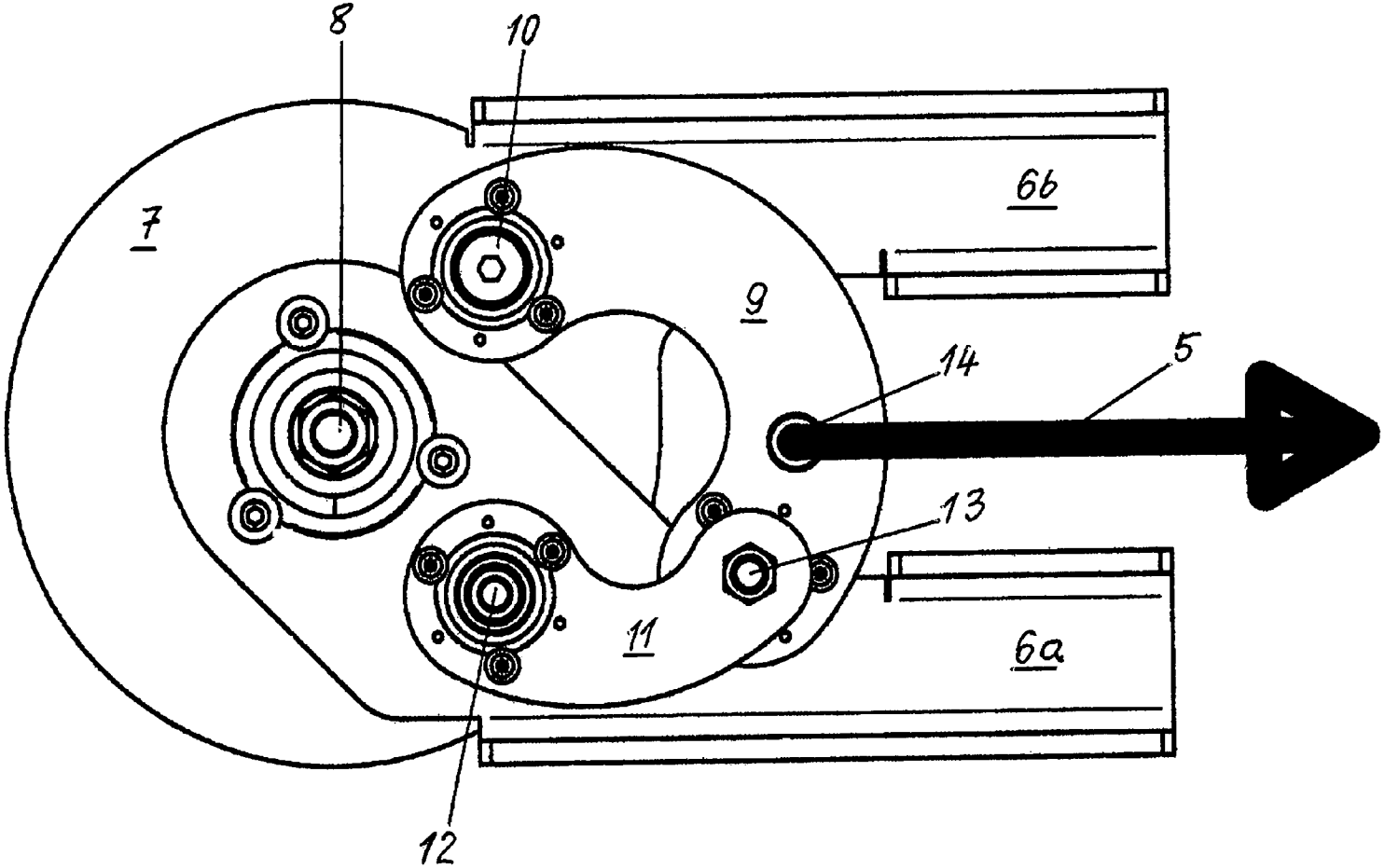
Figure 11:
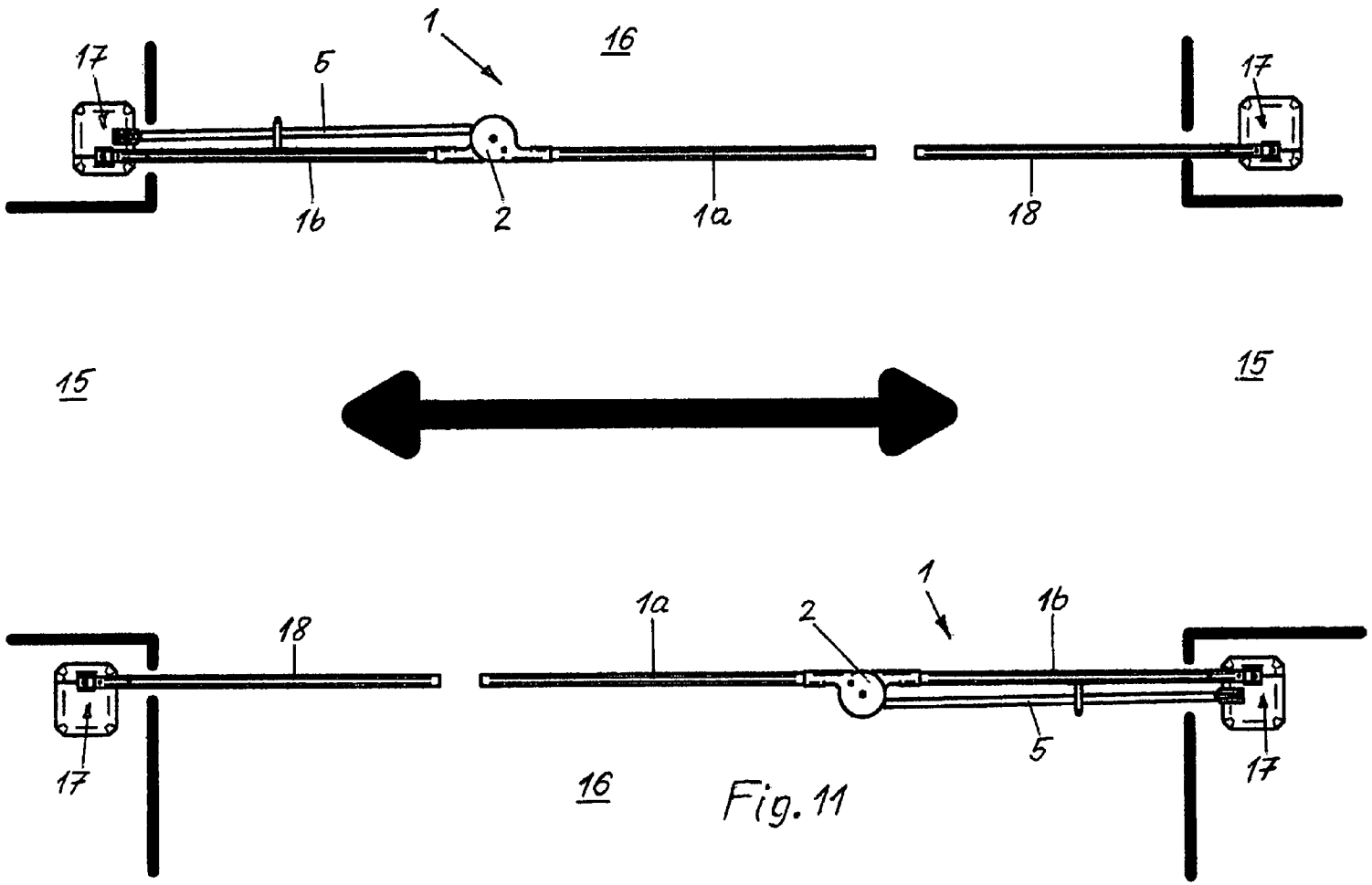
Figure 12:
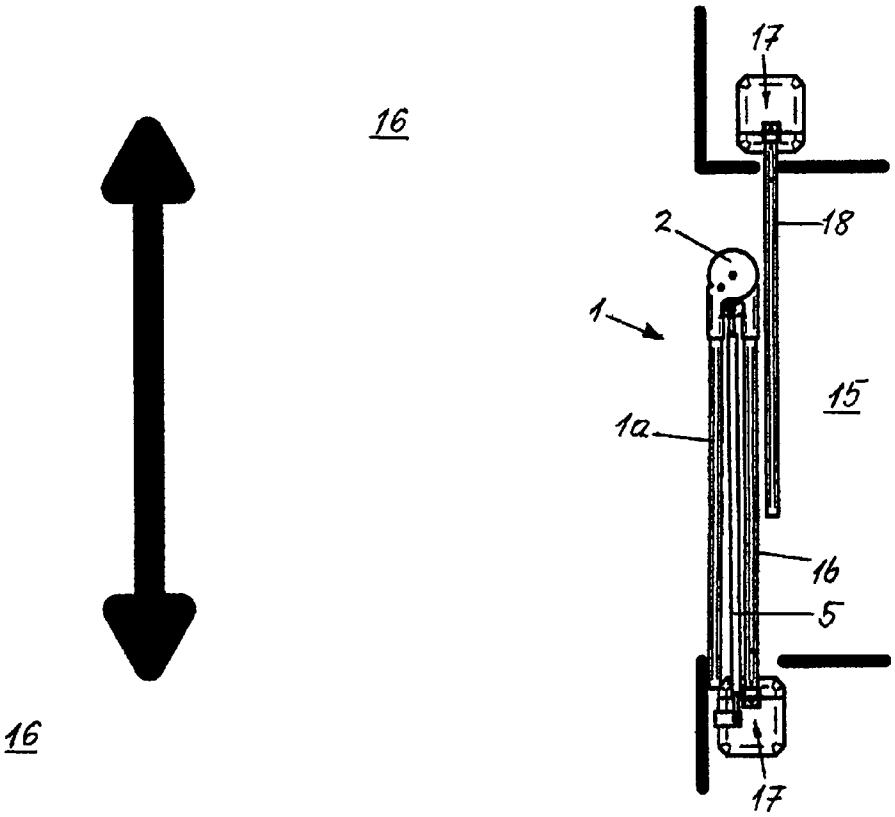
Figure 12:
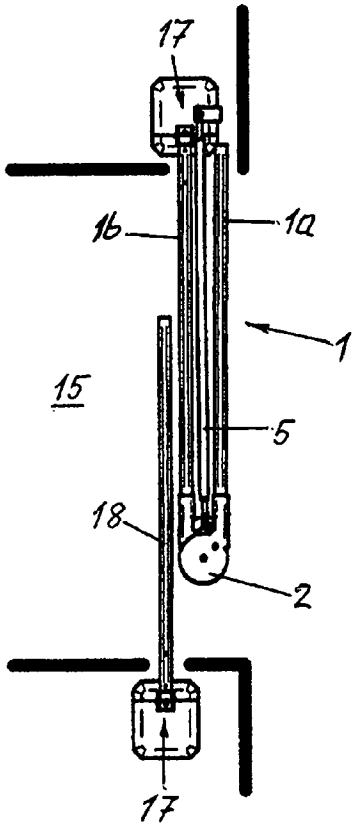
Figure 13:
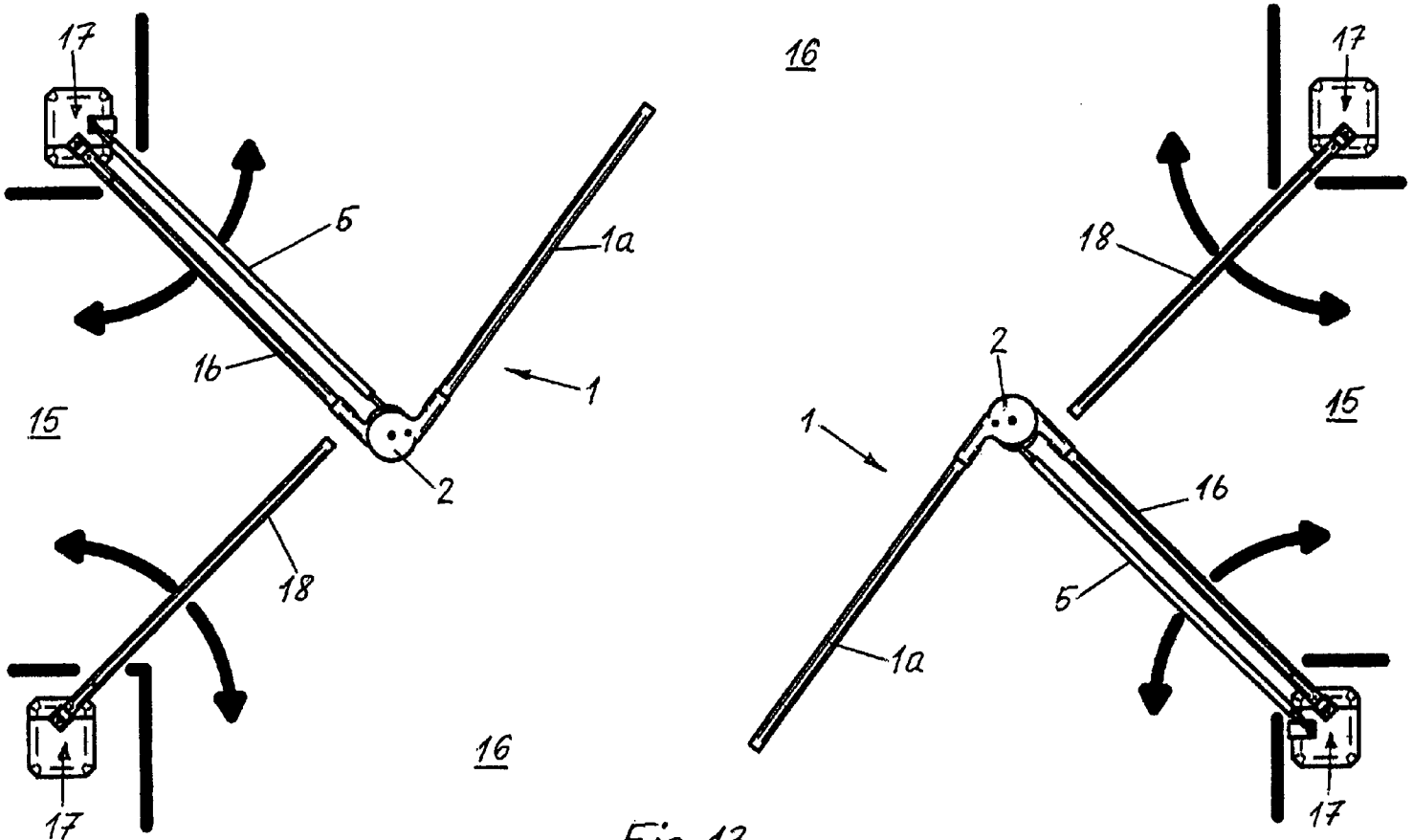
Figure 14:
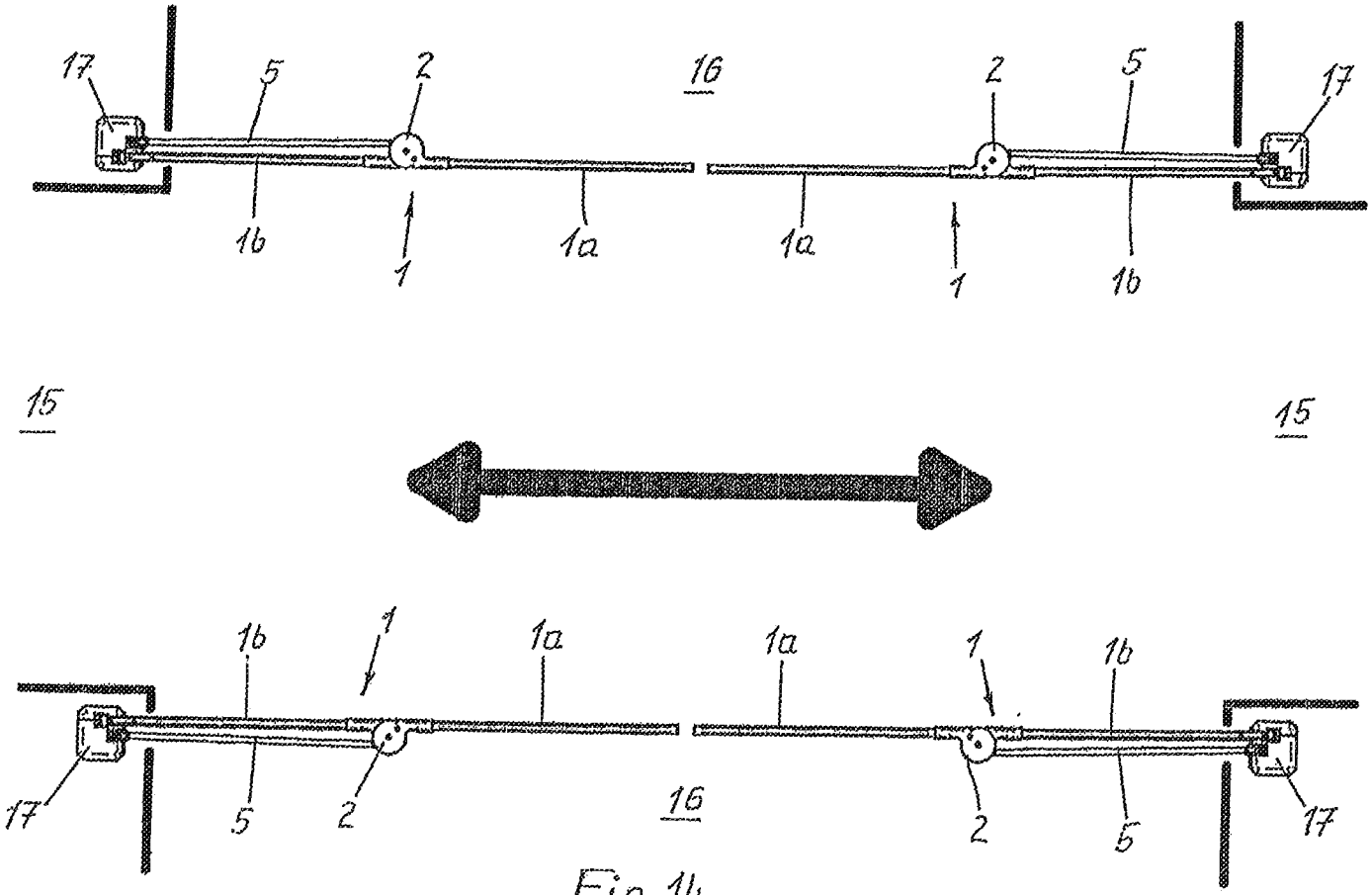

In the following text, the invention will be described more precisely using the appended drawings, in which:

FIG. 1 shows a perspective illustration of a barrier system having a two-part, foldable barrier boom in its position which shuts a path, which barrier boom can advantageously be used in a barrier system according to the invention, FIG. 2 shows a perspective illustration of a barrier system according to FIG. 1 with the barrier boom in its position which opens a path, FIG. 3 shows a perspective illustration of a barrier system according to FIGS. 1 and 2 with the barrier boom in an intermediate position, FIG. 4 shows the plan view of the barrier system according to FIG. 1, FIG. 5 shows the plan view of the barrier system according to FIG. 2, FIG. 6 shows the plan view of the barrier system according to FIG. 3, FIG. 7 shows the perspective view of a linkage which connects the two sections of the two-part barrier boom according to FIG. 1 to FIG. 6, FIG. 8 shows the plan view of a linkage according to FIG. 7 which is partially open, in the position which it assumes when both sections of the barrier boom are aligned with one another, FIG. 9 shows the plan view of the linkage according to FIG. 8 in the position which it assumes when the sections of the barrier boom lie at an angle of 90° with respect to one another during their movement, FIG. 10 shows the plan view of the linkage according to FIG. 8 in the position which it assumes when one (front) section of the barrier boom is folded back entirely onto the other (rear) section, and FIG. 11, FIG. 12 and FIG. 13 diagrammatically show the use of barrier booms on two lines of considerably different width which cross one another, the vehicle entrance of which is to be alternately shut and opened.

FIG. 1 shows a barrier system having a barrier boom 1 in its position which shuts a path. The barrier boom 1 consists of a front section 1*a* which has the free end of the barrier boom 1 and a rear section 1*b* which is connected at its one end to the second end of the section 1*a* by way of what is known as a four-bar linkage 2 (a linkage with four degrees of freedom). At its end 3 which faces away from the linkage 2, the rear section 1*b* is connected to a drive apparatus which is not shown in detail, can be accommodated in a barrier housing 4, and by way of which the barrier boom 1 can be pivoted in a manner known per se by 90° into its position which opens the path and back again; in the embodiment which is shown, the barrier boom 1 can advantageously be pivoted by 90° in a horizontal plane. A guide rod 5 extends along the rear, driveable section 1*b* of the barrier boom 1, which guide rod 5 is mounted with its one end 5*a* on the barrier housing 4 such that it can be pivoted together with the driveable section 1*b* by 90° in a horizontal plane, and the other end 5*b* of which acts on an arm of the four-bar linkage 2 (in this regard, see also FIG. 3). The driveable end 3 of the driveable section 1*b*, which driveable end 3 is connected to the drive apparatus, can be pivoted by way of the drive apparatus not only horizontally by 90°, but can also be displaced by a defined extent on the barrier housing 4 in the longitudinal direction of the section 1*b* (cf. the position of the end 3 in FIG. 1 and FIG. 2).

In order to move the barrier boom 1 out of its position which shuts the path according to FIG. 1 into its position which opens the path according to FIG. 2, it is pivoted horizontally by 90° at its driveable end 3 by way of the drive apparatus. The guide rod 5 is also driven in this movement and it also pivots by 90° at its end 5*a* which is connected to the barrier housing 4, its other end 5*b* acting on a lever of the four-bar linkage 2 in such a way that the driveable end 3 of the driveable section 1*b* of the barrier boom 1 is displaced in the longitudinal direction towards the four-bar linkage 2 on the barrier housing 4; in this way, the four-bar linkage 2 (see below) is moved in such a way that the front section 1*a* of the barrier boom 1 is folded back by 180° onto the driveable section 1*b* in the ideal case, and both sections 1*a* and 1*b* assume a parallel or virtually parallel position with respect to one another. Here, the expression "parallel" or the specification "180°" are not to be understood in strictly geometrical terms; practical or production-related deviations can result. FIG. 3 shows an intermediate position which the barrier boom 1 assumes during this movement. It is therefore achieved that the space requirement for the movement of the barrier boom 1 as an entirety and for its position which opens the path is reduced considerably; if the two sections 1*a* and 1*b* have the same length, the length of the folded barrier boom 1 according to FIG. 2 can be approximately equal to or virtually equal to half the overall length of the elongate barrier boom 1 according to FIG. 1. It is also possible in principle to design the front section 1*a* which has the free end of the barrier boom 1 to be shorter than the driveable section 1*b*. The length of the folded barrier boom 1 will then be equal to a greater fraction of the overall length of the elongate barrier boom 1.

For reasons of clarification, the positions which the barrier boom 1 assumes during its movement out of the position which shuts the path according to FIG. 1 and FIG. 4 via the intermediate position according to FIG. 3 and FIG. 6 into its position which opens the path according to FIG. 2 and FIG. 5 are also reproduced in a plan view in FIGS. 4 to 6. Here, the positional change of the driveable end 3 of the driveable section 1*b* and of the end 5*a* of the guide rod 5 on the barrier housing 4 can also be seen clearly.

FIG. 7 shows a perspective illustration of the four-bar linkage 2 which is used in the invention. The connectors 6*a* and 6*b* for the sections 1*a* and 1*b* of the barrier boom 1 can be seen. The actual linkage 2 is situated between an upper and lower protective plate 7 and is largely covered by the upper protective plate 7 in this illustration. The protective plates 7 are parts of the connectors 6*a* and 6*b* or are connected fixedly to them. FIG. 8 shows a plan view of the four-bar linkage with a removed, upper protective plate 7 and with sections 1*a* and 1*b* of the barrier boom 1 which are aligned with one another. The connector 6*a* for the front section 1*a* of the barrier boom 1 is mounted such that it can be rotated about a central rotational axis of the four-bar linkage 2 in relation to the connector 6*b* for the rear, driveable section 1*b*. A lever 9 which is curved in an approximately semicircular manner is connected by way of its one end in a manner which is spaced apart from the central rotational axis 8 to the connector 6*b* of the driveable section 1*b* such that it can be rotated about an axis 10. A second curved lever 11 is connected at its one end in a manner which is spaced apart from the central rotational axis 8 to the connector 6*a* for the front section 1*a* such that it can be rotated about an axis 12. The two other ends of the levers 9 and 11 are connected to one another such that they can be rotated about a common axis 13. The guide rod 5 which is shown symbolically here by way of an arrow 5 acts at a point of action 14 on the lever 9 which is connected rotatably to the connector 6*b*.

If, in the elongate shut position of the barrier boom 1 (cf. also FIG. 1 and FIG. 4), that is to say when sections 1*a* and 1*b* are aligned with one another, the barrier boom 1 is pivoted horizontally in the direction of the arrow P (cf. FIG. 4) in the example which is described here by way of the drive apparatus which acts on its driveable section 1*b*, the guide rod 5 is also driven in this movement and in the process exerts a pulling force via the point of action 14 on the lever 9 which is connected to the connector 6*b* in an articulated manner; the lever 9 rotates about its axis 10 on the connector 6*b* and drives the lever 11 which is connected to it in an articulated manner at the common axis 13 and is connected at its other end in an articulated manner to the connector 6*a*, with the result that the latter follows the movement by rotating about the common axis 13 of the two connectors 6*a* and 6*b*. FIG. 9 shows the positions of the individual parts of the four-bar linkage 2 in an intermediate position of the connectors 1*a* and 1*b* and therefore the front section 1*a* and the rear, driveable section 1*b* of the barrier boom 1 after a rotation at the four-bar linkage 2 by 90°, which corresponds to pivoting of the barrier boom 1 or its driveable section 1*b* by approximately 45° in the direction of the arrow P (cf. FIG. 6). The barrier boom 1 or its driveable section 1*b* is driven further in the direction of the arrow P, and the guide rod 5 continues to exert its pulling force via the point of action 14 on the lever 9, and the latter rotates further about its axis 10 on the connector 6*b* and drives the lever 11 during its movement. The lever 11 transmits the movement to the connector 6*a* which is connected to it in an articulated manner, and the latter follows the movement by rotating further about the central rotational axis 8 in the direction of the arrow Q (cf. FIG. 6), while driving the front section 1*a* of the barrier boom 1, until it finally lies parallel to the connector 6*b* according to FIG. 10 in the end position, and accordingly the front section la is folded back onto the driveable section 1*b* by 180° or approximately 180°, with the result that both sections 1*a* and 1*b* according to FIG. 5 lie parallel to one another, which corresponds to pivoting of the barrier boom 1 or its driveable section 1*b* on the barrier housing by 90° (cf. FIG. 2 and FIG. 5); afterwards, the path or the previously shut vehicle entrance is opened.

It goes without saying that the movements at the four-bar linkage 2 proceed in the opposite direction during a reverse movement of the barrier boom 1 into its elongate shut position according to FIG. 1 and FIG. 3.

FIGS. 11 to 13 show the use according to the invention of the barrier boom on two paths or lines which cross one another, for example a production line and a delivery line, one line 16, for example the delivery line 16, being considerably wider than, namely more than twice as wide as, the line 15 which crosses, for example the production line 15. Both lines 15 and 16 have to be shut and opened alternately, in order firstly to allow the production to proceed and secondly for it to be possible to supply required assembly parts at defined positions. Because the ceiling height is as a rule very low in production facilities of this type, vertically pivoting barrier booms are usually unsuitable for areas of application of this type. This problem can be bypassed, precisely by horizontally pivoting barrier booms being used. The two lines have to be adapted to their purposes and therefore often have different widths. If the wider line is at most twice as wide as the narrower line, both can be shut completely in both directions if in each case one conventional barrier with a rigid, horizontally pivoting barrier boom is installed on the four corners of the crossing, and the barrier booms are pivoted by 90° with respect to one another in order to shut or open a line. During the shutting of the narrower line, the barrier booms can overlap partially.

In the example which is shown in FIG. 11, FIG. 12 and FIG. 13, one line 16 is more than twice as wide as the narrow line 15, however. Since a rigid, conventional barrier boom may not in any case be longer than the width of the narrower line 15, the wider line 16 can no longer be shut completely in a case of this type by way of conventional, rigid barrier booms; a gap with a greater or lesser width would then always remain between the free ends of the barrier booms. This problem can be eliminated with the aid of barrier booms 1, as have been described above.

FIG. 11 shows two lines 15 and 16 of different widths which cross one another and of which the wider line 16 is more than twice as wide as the narrow line 15. A barrier system 17 with a barrier boom which can be pivoted horizontally by 90° is installed at each of the four corners of the crossing. The two barrier systems 17 which lie diagonally opposite one another have in each case one conventional barrier boom 18 which is inherently rigid; the length of the two barrier booms 18 is preferably less than the width of the narrow line 15, but at most equal to the width of the narrow line 15. The other two barrier systems 17 which lie diagonally opposite one another have in each case one barrier boom 1 which, as described above, can preferably be folded to half its length. FIG. 11 shows the system in the state in which the wider line 16 is completely shut in both directions and the narrow line is opened in both directions. The two foldable barrier booms 1 are situated in their elongate state, in which their two sections 1*a* and 1*b* are aligned with one another; they thus cover the majority of the width of the line 16, for example up to ⅔ of the width, whereas the two conventional barrier booms 18 with a rigid length of the barrier systems 17 which lie in each case directly opposite one another cover the smaller part, one third of the width in the example, of the wider line 16. If the wider line 16 is now to be opened and the narrow line 15 is to be shut, all four barrier booms 1 and 18 are pivoted horizontally by 90° in the direction of the narrow line 15, the sections 1*a* of the two foldable barrier booms 1, as described above, being folded back onto the respective driveable section 1*b* in the four-bar linkage 2, until the sections 1*a* lie parallel or virtually parallel to the driveable sections 1*b* of the barrier booms 1. Afterwards, the barrier booms 1 and 18 assume the positions according to FIG. 12, in which the wider line is opened and the narrower line 15 is shut. The overlapping of the barrier booms 1 and 18 in this position is not disruptive. In order to again shut the wider line 16 and to open the narrow line 15, the barrier booms 1 and 18 are pivoted in the opposite direction by 90°, the foldable barrier booms 1 unfolding again and assuming their elongate position according to FIG. 11.

FIG. 13 shows the barrier system according to FIGS. 11 and 12 in an intermediate position of the barrier booms 1 and 18 after pivoting by approximately 45° in one or the other direction.

LIST OF REFERENCE NUMERALS

1 Barrier boom
1*a* Front section of the barrier boom
1*b* Rear, drivable section of the barrier boom
2 Linkage, four-bar linkage
3 Driveable end of the section 1*b*
4 Barrier housing
5 Guide rod
5*a* End of the guide rod on the barrier housing
5*b* End of the guide rod on the linkage
6*a* Connector of section 1*a* on the linkage
6*b* Connector of section 1*b* on the linkage
7 Protective plates
8 Central rotational axis
9 Lever on the connector 6*b*
10 Axis
11 Lever on the connector 6*a*
12 Axis
13 Common axis
14 Point of action
15 Narrow line
16 Wide line
17 Barrier systems
18 Conventional barrier boom

The invention claimed is:

1. A barrier system for alternately shutting and opening a first vehicle entrance or pedestrian entrance of a first line or first transport path and a second vehicle entrance or pedestrian entrance of a second line or second transport path, wherein the second line crosses the first line and wherein the second line is at least twice as wide as the first line, wherein the first line together with the second line form four inner corners wherein each corner is associated with a barrier system with a barrier boom wherein the barrier boom can be pivoted horizontally out of the vehicle entrance position of the first line into the vehicle entrance position of the second line wherein two of the barrier systems, which lie diagonally opposite have a barrier boom which can be folded lengthwise from an elongate position, and two remaining barrier systems which are disposed diagonally opposite to each other have each one conventional associated barrier boom, which is rigid over its entire length.

2. The barrier system according to claim 1, characterized in that the barrier booms which can be folded lengthwise consist of a front section which has the free end of the barrier boom and a rear drivable section which is connected to a drive device, in that the front section and rear section are connected to one another at their ends which abut one another by way of a four-bar linkage (four-member coupling linkage with one degree of freedom), and in that the front section which has the free end of the respective barrier boom can be pivoted in the four-bar linkage from an elongate position which is aligned with the rear driveable section into a position which is folded back onto the rear driveable section and back again.

3. The barrier system according to claim 1, characterized in that the barrier booms which can be folded lengthwise cover more than half of the vehicle entrance of the wider line in their elongate position, that is to say with front section and rear drivable section which are aligned with one another, and the barrier booms which are rigid over the entire length cover the remaining part of the vehicle entrance of the wider line.

4. The barrier system according to claim 1, characterized in that the barrier booms which can be folded lengthwise cover half of the vehicle entrance of the wider line in their elongate position, that is to say with front section and rear drivable section which are aligned with one another.

5. The barrier system according to claim 1, characterized in that the barrier booms which can be folded lengthwise of two barrier systems which lie diagonally opposite one another cover more than half of the vehicle entrance of the wider line (16) in their elongate position, that is to say with front section and rear drivable section which are aligned with one another, and the barrier booms which can be folded lengthwise of the two other barrier systems which lie diagonally opposite one another cover the remaining part of the vehicle entrance of the wider line.

6. Barrier system according to claim 1 characterized in that the length of the barrier booms which can be folded lengthwise is determined in that way that they cover more than half of the vehicle entrance of the wider line in their elongate position, that is to say with the said sections aligned with one another and that the length of the barrier booms which are rigid over the entire length is determined in that way that they cover the remaining part of the vehicle entrance of the wider line.

7. Barrier system according to claim 1, characterized in that the length of the barrier booms which can be folded lengthwise is determined in a way that they cover half of the vehicle entrance of the wider line in their elongate position, that is to say with the said sections aligned with one another.

8. Barrier system according to claim 1, characterized in that the length of the barrier booms which can be folded lengthwise of two barrier systems which lie diagonally opposite one another is determined in a way that they cover more than half of the vehicle entrance of the wider line in their elongate position, that is to say with the said sections aligned with one another and that the length of the barrier booms which can be folded lengthwise of the two other barrier systems which lie diagonally opposite one another is determined in that way that they cover the remaining part of the vehicle entrance of the wider line.

9. The barrier system according to claim 2, characterized in that the four-bar linkage of each foldable barrier boom has a front connector for the front section of the barrier boom, which front section has the free end of the barrier boom, and a rear drivable connector for the rear, driveable section of the barrier boom, and the front connector of the front section can be pivoted about a central axis of the four-bar linkage in relation to the rear connector of the rear driveable section until it lies parallel to the rear connector of the rear driveable section, in that the four-bar linkage has a first lever and a second lever which are connected to one another at their one ends such that they can be pivoted about a common axis, in that the first lever is connected by way of its second end to the rear connector of the rear driveable section such that it can be pivoted about an axis, and the second lever is connected by way of its second end to the front connector of the front section of the barrier boom such that it can be pivoted about an axis, and in that the first lever which is connected in an articulated manner to the rear connector of the rear driveable section has a point of action for a guide rod which is arranged parallel to the rear driveable section and can be pivoted together with the latter.

10. The barrier system according to claim 2, characterized in that the length of the front section which has the free end of the barrier boom is equal to the length of the rear driveable section.

11. The barrier system according to claim 2, characterized in that the front section which has the free end of the barrier boom is shorter than the rear driveable section.

12. The barrier system according to claim 2, characterized in that the barrier booms which can be folded lengthwise cover more than half of the vehicle entrance of the wider line in their elongate position, that is to say with front section and rear section which are aligned with one another, and the barrier booms which are rigid over the entire length cover the remaining part of the vehicle entrance of the wider line.

13. The barrier system according to claim 2, characterized in that the barrier booms which can be folded lengthwise cover half of the vehicle entrance of the wider line in their elongate position, that is to say with front section and rear section, which are aligned with one another.

14. The barrier system according to claim 2, characterized in that the barrier booms which can be folded lengthwise of two barrier systems which lie diagonally opposite one another cover more than half of the vehicle entrance of the wider line in their elongate position, that is to say with a front section and a rear section, which are aligned with one another, and the barrier booms which can be folded lengthwise of the two other barrier systems which lie diagonally opposite one another cover the remaining part of the vehicle entrance of the wider line.

* * * * *